United States Patent [19]

Pehrsson

[11] 4,273,545

[45] Jun. 16, 1981

[54] MARINE PROPELLER UNIT

[75] Inventor: Anders L. Pehrsson, Kristinehamn, Sweden

[73] Assignee: Aktiebolaget Karlstads Mekaniska Werkstad, Karlstad, Sweden

[21] Appl. No.: 78,830

[22] Filed: Sep. 25, 1979

[30] Foreign Application Priority Data

Oct. 2, 1978 [SE] Sweden ..... 7810328

[51] Int. Cl.[3] ..... B63H 23/00

[52] U.S. Cl. ..... 440/75

[58] Field of Search ..... 115/34 R, 35, 37, 39, 115/41, 17, 18 R, 1; 114/151; 74/664, 665 R, 665 B, 665 F, 665 G, 665 GC, 665 K; 440/98, 99, 100, 75

[56] References Cited

U.S. PATENT DOCUMENTS

| | | | |
|---|---|---|---|
| 2,479,119 | 8/1949 | Johnson | 115/41 R |
| 2,909,031 | 10/1959 | Kiekhaefer | 115/17 |
| 3,259,100 | 7/1966 | Keikhaefer | 440/75 |
| 3,487,803 | 1/1970 | Alexander, Jr. | 115/34 R |
| 3,492,906 | 2/1970 | Hauser | 85/1 |
| 3,589,326 | 6/1971 | Celli | 115/35 |

FOREIGN PATENT DOCUMENTS

| | | | |
|---|---|---|---|
| 982882 | 2/1976 | Canada | 440/75 |
| 378577 | 9/1975 | Sweden | 440/75 |
| 469329 | 7/1937 | United Kingdom | 115/35 |

*Primary Examiner*—Trygve M. Blix
*Assistant Examiner*—Jesús D. Sotelo
*Attorney, Agent, or Firm*—Browdy & Neimark

[57] ABSTRACT

A marine propeller unit having a propeller (1) mounted on a horizontal propeller shaft (2) which is journalled in a gear housing (3), which is fixedly connected to a hollow strut (4) whose upper end is mounted in the bottom of a water-going vessel for rotation about a substantially vertical axis. The propeller is driven by a drive machinery within the vessel. Two conical gears (7/9, 8/10) on the propeller shaft are coupled to two vertical gear-drive shafts (11,12) journalled within the strut. The two gear-drive shafts are coupled by their respective cylindrical gears (19, 20) to an inner vertical drive shaft (16) and an outer tubular drive shaft (17) respectively, the tubular drive shaft being arranged outside the inner drive shaft (16) and coaxial therewith. These coaxial drive shafts are connected together and to the output shaft (21) of the drive machinery by resilient couplings (22, 23) in a manner such as to permit said shafts to be driven together. Because the power to the propeller shaft is distributed between duplicate gears and shafts, the dimensions of the gear housing and strut can be such as to ensure that the propeller efficiency is not excessively reduced, even when high propeller power is required. By torsion in the coaxial shafts and through the resilient couplings, the power to the gears is so distributed as to prevent them from being overloaded.

2 Claims, 1 Drawing Figure

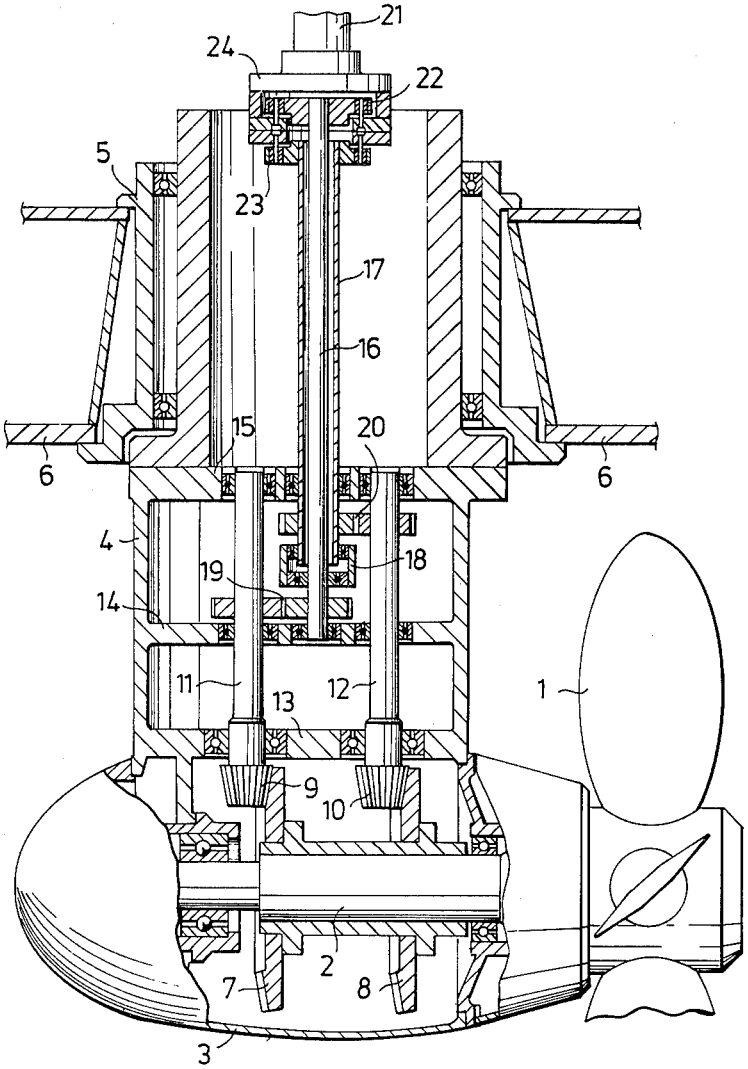
21
24
22
5
23
17
16
15
20
6
6
4
19
18
14
11
12
1
13
9
10
2
7
8
3

MARINE PROPELLER UNIT

BACKGROUND OF THE INVENTION

The present invention relates to a marine propeller unit of the kind arranged to be mounted on the underside of a water-going vessel and to be connected by means of a vertically extending shaft to a driving machinery arranged within said vessel. Propeller units of this kind are becoming more and more common in special-duty vessels requiring a high degree of manoeuverability and thrust control, e.g. such vessels as tugs, ferries, floating cranes, drill rigs, drill ships, pipe-laying ships, cable-laying ships etc.

Such a propeller unit is normally called a thruster, and one known embodiment comprises a streamlined gear housing in which a substantially horizontal propeller shaft is journalled, the propeller being mounted on said shaft. The gear housing includes a conical gearing with the gear wheel or gear ring mounted on the propeller shaft and the drive mounted on the lower end of a substantially vertical drive shaft. The gear housing is carried by a hollow strut which is connected at its lower end to the gear housing, while the upper end of the strut is mounted to the underside of the vessel. The strut is often arranged for rotation relative to the hull of the vessel, about an axis which coincides with the substantially vertical drive shaft of the propeller unit. The upper end of the drive shaft is arranged for connection to a drive engine for driving the propeller. When the propeller unit is one in which the strut is arranged to be rotatable, the upper end of the strut is arranged for connection to a steering mechanism for rotating the propeller unit.

When it is desired to construct a propeller unit of this kind in a manner such as to obtain a high-power output, a particular problem is encountered, insomuch as in order to meet this requirement the conical gearing between the vertical drive shaft and the horizontal propeller shaft must be of correspondingly larger diameter. An increase in the diameter of the conical gear wheel mounted on the propeller shaft requires a corresponding increase in the diameter of the gear housing. The gear housing, which normally has the form of a rotation-symmetrical streamline housing arranged coaxially with the propeller, influences the propeller flow and therewith the efficiency of the propeller. In order to ensure in the best possible manner that the inherent propeller efficiency is maintained, the disturbance of the propeller flow must be as small as possible, which means that the diameter of the gear housing should not be excessively large. The problem of maintaining the diameter of the gear housing within acceptable limits becomes progressively more difficult the larger the diameter of the conical gear wheel becomes, in the attempt to increase the power output of the propeller unit.

SUMMARY OF THE INVENTION

Consequently, the object of the present invention is to provide a novel form of propeller unit of the aforedescribed kind which gives a high propeller power and a high propeller efficiency.

According to the invention this object is achieved in a propeller unit of the aforedescribed type in that the angled gearing between the propeller shaft and the vertical drive shaft system comprises at least two conical gears arranged axially spaced on the propeller shaft and drivingly connected to the lower ends of at least two mutually parallel, substantially vertical geardrive shafts journalled in the hollow strut and in that the upper ends of said gear drive shafts are connected through separate gears to the lower ends of a respective one of a corresponding number of mutually coaxial, vertical drive shafts, which have their upper ends arranged for connection to the drive machinery within the vessel.

The upper ends of the coaxial drive shafts are preferably coupled to each other, preferably by means of resilient couplings, so as to be jointly driven from the drive machinery within the vessel.

As in the propeller unit according to the invention the power to be transferred from the drive machinery to the propeller shaft is shared in the propeller unit between two gear drive shafts connected to two conical gears arranged axially spaced on the propeller shaft, the diameter of the gear wheels of said two gears mounted on the propeller shaft can be made correspondingly smaller, which means that the diameter of the gear housing can also be made correspondingly smaller. In that the two gear drive shafts of the two conical gears are coupled by means of cylindrical gears to two, mutually coaxial, substantial vertical drive shaft which are at their upper ends connected to the drive machinery for the propeller unit and which are arranged coaxially with the axis of rotation of the strut, it is possible to turn the propeller unit in a manner such as to change the direction of thrust of the propeller.

Particular advantages are obtained when, in accordance with a further development of the invention, the said coaxial drive shafts comprise an inner shaft and an outer, tubular shaft which encloses the inner shaft and these two shafts are connected at their lower ends by means of separate cylindrical gears to a respective one of the gear drive shafts connected to the conical gears, while the upper ends of said coaxial shafts are connected together by means of a resilient coupling element, to enable said shafts to be jointly connected to an output shaft of the propeller-drive machinery located in the vessel. By means of such an arrangement there is obtained in a constructively simple efficient and space-saving manner such resiliency in the transmission means for transmitting the driving force from the propeller-drive machinery to the propeller shaft as to ensure an equal power sharing to the gears.

BRIEF DESCRIPTION OF THE DRAWING

The invention will now be described in more detail with reference to the accompanying drawing, which illustrates in a schematic, partly cut-away side view, an exemplary embodiment of a propeller unit constructed in accordance with the invention.

DETAILED DESCRIPTION OF THE PREFERRED EMBODIMENT

The illustrated propeller unit comprises a propeller 1 whose hub is mounted on a horizontal propeller shaft 2 journalled in a gear housing 3, said housing having the form of a streamlined pod. Although the propeller of the illustrated embodiment has adjustable blades so that the pitch can be varied, the blades of the propeller may also be fixed. For the sake of simplicity the means required for changing the pitch of a propeller with adjustable blades are not illustrated in the drawing since they can be designed in many different ways known to the art and do not form any part of the invention. The gear housing 3 is fixedly connected to the lower end of a vertically extending, hollow strut 4, the upper part of which is rotatably mounted in a bearing block 5 which is fixedly mounted in a seating in the underside 6 of a water-going vessel. With respect to the propeller flow, the strut 4 has a streamlined cross-section. The upper part of the rotatable strut 4 is coupled to a steering mechanism by which the strut 4, and therewith the complete propeller unit, can be rotated in a manner to obtain the desired thrust direction. The manner in which the strut can be coupled to the steering mechanism is known in the art and will not therefore be described.

The propeller shaft 2 is arranged to be driven by a drive machinery arranged within the vessel over a transmission system, hereinafter described, comprising gears and substantially vertically extending shafts. The transmission system extends from the gear housing 3 up through the strut 4 and is connected to an output shaft 21 of the drive machinery.

In accordance with the invention, the propeller shaft 2 is driven by means of two conical gears 7 and 8 which are fixedly mounted on said shaft in axial spacedapart relationship. Mounted on the lower ends of two, substantially vertical and mutually parallel gear-drive shafts 11 and 12, respectively, are two conical gears 9 and 10 corresponding to said gears 7 and 8 respectively. The shafts 11 and 12 are journalled in partition walls or cross-walls 13, 14 and 15 in the hollow strut 4. The purpose of this design is to enable the drive power applied to the propeller shaft 2 to be evenly shared on the two conical gears 7/9 and 8/10 respectively, which then, in principle, need only be constucted for half the total power. With respect to the total power output, this means that the gear wheels 7 and 8 on the propeller shaft 2 need be of but small diameter, while permitting The use of a relatively small gear housing 3.

To enable the propeller unit to be connected to an output shaft of the drive machinery in the vessel, the gear drive shafts 11 and 12 of the two conical gears 7/9 and 8/10 are coupled together in a manner such as to obtain uniform load sharing between the two conical gears 7/9 and 8/10, thereby preventing one of said gears being overloaded.

In accordance with the embodiment of the invention illustrated in the drawing, this has been achieved in a simple, space-saving and effective manner by means of specially designed transmission system in the strut 4.

In the upper part of the rotatable strut 4 there is arranged a central transmission which is coaxial with the vertical axis of rotating of the strut 4 which comprises an inner shaft 16 and an outer tubular shaft 17 which is arranged outside the inner shaft 16 and is coaxial therewith. The inner shaft 16 is journalled at its lower end in the cross wall 14 in the strut 4, while the lower end of the outer, tubular shaft 17 is journalled in the cross wall 15. The inner shaft 16 and the outer, tubular shaft 17 are mutually centered at the lower end of the outer shaft 17 by means of a sleeve 18 which is journalled for rotation on both the inner shafts 16 and the outer shaft 17. The inner shaft 16 is coupled at its lower end to the gear drive shaft 11 for the concial gear 7/9 by means of a cylindrical gear 19. In a corresponding manner, the outer, tubular shaft 17 is coupled at its lower end to the gear drive shaft 12 of the other conical gear 8/10 via a cylindrical gear 20.

The inner shaft 16 and the outer, tubular shaft 17 are both connected at their upper ends to an input drive shaft 21, shown only partially, from the drive machinery (not shown) arranged within the vessel. In the illustrated embodiment, the inner shaft 16 and the outer, tubular shaft 17 are each connected to a coupling flange 24 on the input drive shaft 21 by means of elastic shaft-couplings 22 and 23 of a known kind.

It will be understood that the inner shaft 16 and the outer, tubular shaft 17 permit along the length thereof a certain amount of torsion which together with the resiliency of the couplings 22 and 23 will provide uniform distribution of power between the two conical gear 7/9 and 8/10 and their associated cylindrical gears 19 and 20.

I claim:

1. A marine propeller unit for mounting to an underside of a vessel, the unit comprising a propeller mounted on a horizontal propeller shaft, a gear housing in which said propeller shaft is journalled, a vertical hollow strut attached to and supporting said gear housing at its lower end and having its upper end adapted for connection to said underside of said vessel, a gearing system housed in said gear housing and connecting said propeller shaft to a transmission shaft system extending substantially vertically upwards from said gear housing through said hollow strut for connection to a drive machinery located within said vessel, said gearing system and said transmission shaft system including at least two conical gears mounted axially spaced on said propeller shaft, at least two mutually parallel, substantially vertical gear drive shafts journalled for rotation within said strut with their lower ends connected to respective ones of said conical gears, a first vertical transmission shaft having its lower end coupled to one of the gear drive shafts through a first cylindrical gear and extending upwards so as to have its upper end inside the vessel, and a tubular second vertical transmission shaft coaxially surrounding said first transmission shaft and having its lower end coupled to the other gear drive shaft through a second cylindrical gear and extending upwards so as to have its upper end close to the upper end of said first transmission shaft, said first and second transmission shafts having their upper ends coupled together so as to be driveable jointly and in the same direction of rotation from said drive machinery within the vessel.

2. A propeller unit as claimed in claim 1, comprising resilient coupling means connecting the upper ends of said first and second transmission shafts to each other and to an output shaft of said drive machinery.

* * * * *